US007850486B2

(12) United States Patent
Zhu

(10) Patent No.: US 7,850,486 B2
(45) Date of Patent: Dec. 14, 2010

(54) ELECTRICAL CONNECTOR PROVIDED WITH RETAINING MEMBER

(75) Inventor: Yu Zhu, Shenzhen (CN)

(73) Assignee: Hon Hai Precision Ind. Co., Ltd., Taipei Hsien (TW)

( * ) Notice: Subject to any disclaimer, the term of this patent is extended or adjusted under 35 U.S.C. 154(b) by 0 days.

(21) Appl. No.: 12/482,498

(22) Filed: Jun. 11, 2009

(65) Prior Publication Data

US 2009/0311887 A1 Dec. 17, 2009

(30) Foreign Application Priority Data

Jun. 11, 2008 (CN) ..... 2008 2 0301121

(51) Int. Cl.
*H01R 13/66* (2006.01)

(52) U.S. Cl. ..... 439/570; 439/566; 439/79

(58) Field of Classification Search ..... 439/566, 439/570, 571, 79
See application file for complete search history.

(56) References Cited

U.S. PATENT DOCUMENTS 6,053,763 A * 4/2000 Brennan et al. ..... 439/491
6,086,416 A * 7/2000 Choy ..... 439/567
6,475,031 B1 * 11/2002 Wu ..... 439/570
2007/0128917 A1 * 6/2007 Ho ..... 439/331

FOREIGN PATENT DOCUMENTS

CN 2752990 1/2006

* cited by examiner

*Primary Examiner*—Hien Vu
(74) *Attorney, Agent, or Firm*—Wei Te Chung; Andrew C. Cheng; Ming Chieh Chang

(57) ABSTRACT

An electrical connector electrically mounted on a circuit board for connecting with a complementary connector, which comprises an insulative housing, a plurality of contacts received in the housing and a retaining member fixed in the insulative housing for fastening the connector onto the circuit board. The insulative housing includes a base portion, an inserting portion extending forwardly from the base portion and a bottom wall extending forwardly from the bottom of the base portion. Said retaining member comprises two first retaining patches fixed in two opposite sides of the insulative housing. On the front end of the bottom, there defined a plurality of receiving slot, said retaining member further comprises several second retaining patches correspondingly received in said receiving slots. The connector is stably fastened onto the circuit board through the second retaining patch, therefore, can avoid the connector dropping from the circuit board when the inserting force is too large or the inserting direction is slat.

3 Claims, 4 Drawing Sheets

ELECTRICAL CONNECTOR PROVIDED WITH RETAINING MEMBER

BACKGROUND OF THE INVENTION

1. Field of the Invention

The present invention relates to the art of electrical connectors, and more particularly to an electrical connector provided with a retaining member, construction of which is designed to fasten the connector on a circuit board.

2. Description of the Related Art

As the operation performance of a Central Processing Unit (CPU) in an electrical product has been great improved, the data transfer speed between an electrical product and an external device, especially a standard external device such as hard disk device or optical disk device etc., also need to be improved. Since the Serial ATA interface provides a high transfer speed, it's gradually used as the main interface between an electrical product and an external device.

The Chinese patent with an issue number 2752990 discloses an electrical connector having a serial ATA interface, which is mounted on a circuit board and is able to transfer both power signal and digital signal. This connector includes an insulating housing and a plurality of contacts received in the housing. Said housing includes a base portion extending along a transverse direction, two lead-in portions extending from two ends of said base portion and an inserting portion extending forwardly from the base portion. The inserting portion is divided into two parts, one is power inserting portion and another is signal inserting portion.

On each external side of said lead-in portion, there defines two first mounting slots for separately receiving a retaining patch. On the rear end of the base portion and at the joint position between the power inserting portion and signal inserting portion, there defines a second mounting slot for also receiving a retaining patch. When the connector is mounted on a circuit board, the contacts of the connector are separately soldered with the corresponding circuit on the circuit board, the retaining patches received in the first and second mounting slot joint with the circuit board, according to the structure, the connector is fastened on the circuit board.

A complementary connector mates with said connector mounted on the circuit board guided by the lead-in portion of the connector. The insert/pull out force will be focused on the mating side of the connector when the complementary connector is inserted into or pulled out from the connector. As the operating force from user is very large that may result in the insert/pull out force made on the connector also is very large, or the inserting operation departures from a correct inserting direction, that all may result in the connector loose even drop from the circuit board. Hence, it's necessary to ameliorate the exist connector to overcome said drawbacks.

SUMMARY OF THE INVENTION

An object of the invention is to provide a connector that can be retained on a circuit board stably.

An electrical connector according to an embodiment of the present invention is electrically mounted on a circuit board for mating with a complementary connector. The connector includes an insulative housing, a plurality of contacts received in the housing and a retaining member received in the housing for fastening the connector on a circuit board. The insulative housing includes a base portion, an inserting portion extending forward from the base portion and a bottom wall extending forwardly from the bottom of the base portion, each contact includes a mating portion and a tail portion jointed with the circuit board. The retaining member includes two first retaining patch fixed on the two sides of the insulative housing. At the front end of the bottom wall of the insulative housing, there defines at least one receiving slot, said retaining member further includes at least one second retaining patch correspondingly received in said receiving slot.

The connector according with the present invention are mounted on the circuit board more stably since the second retaining patch is set at the front end of the bottom wall, therefore, it can avoid the connector from being dropped from the circuit board as the inserting force from the complementary connector is too large or the complementary connector is inserted into the connector slantways.

Other features and advantages of the present invention will become more apparent to those skilled in the art upon examination of the following drawings and detailed description of preferred embodiments, in which:

DETAILED DESCRIPTION OF PREFERRED EMBODIMENT

Figure 1:
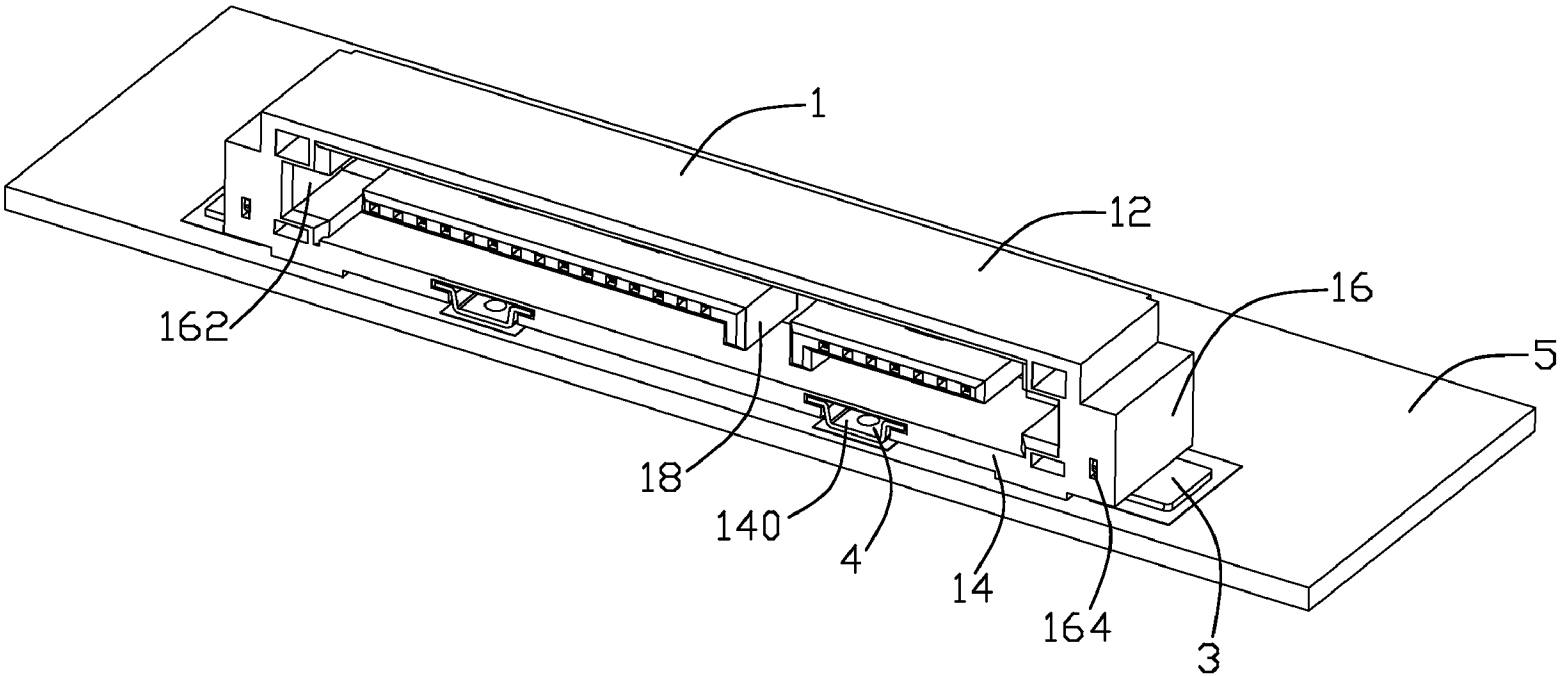
FIG. 1 is a perspective view of an electrical connector mounted on a printed circuit board according to an embodiment of the present invention.
Figure 2:
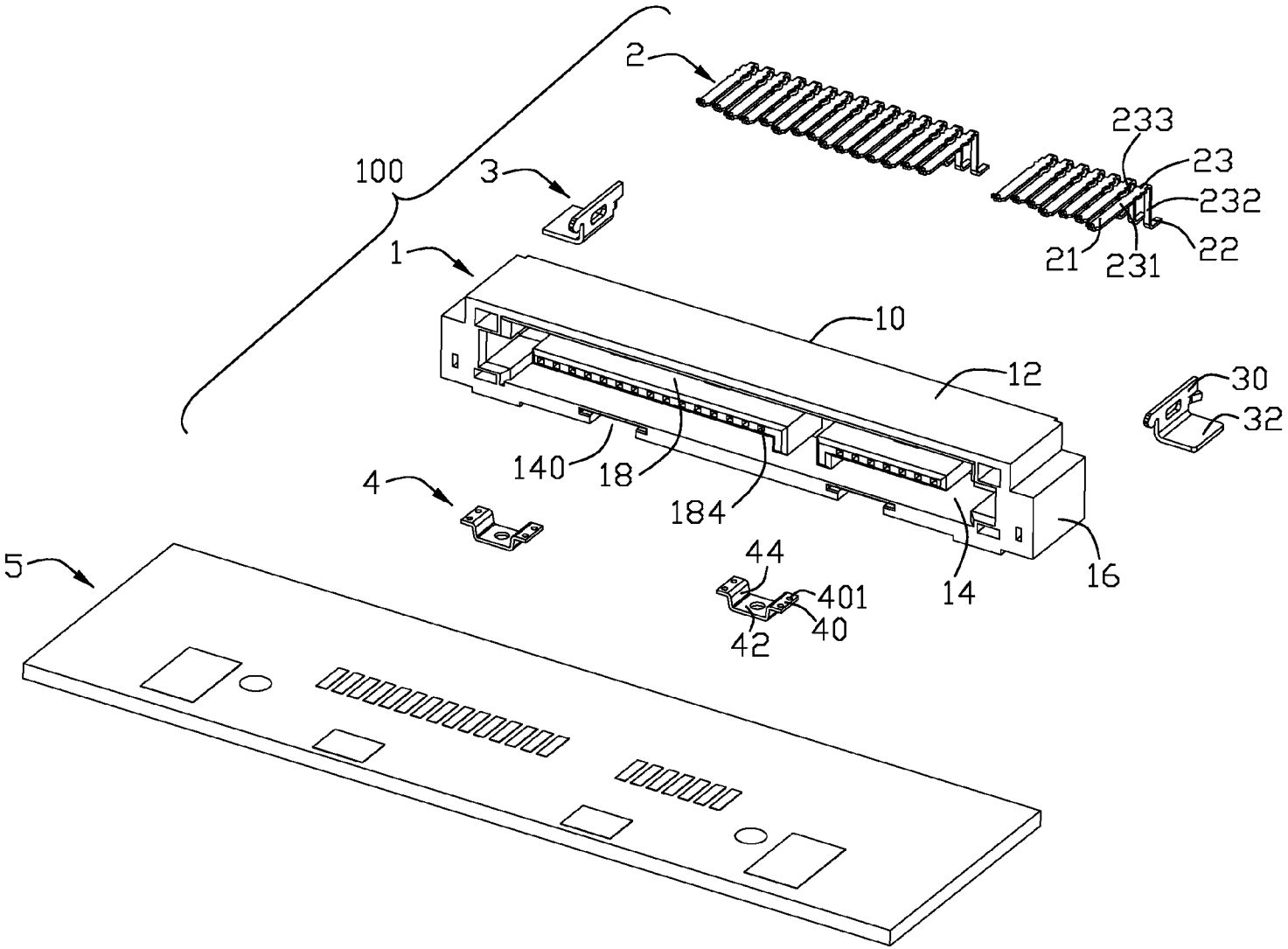
FIG. 2 is an exploded, perspective view of the electrical connector and the printed circuit board of FIG. 1.
Figure 3:
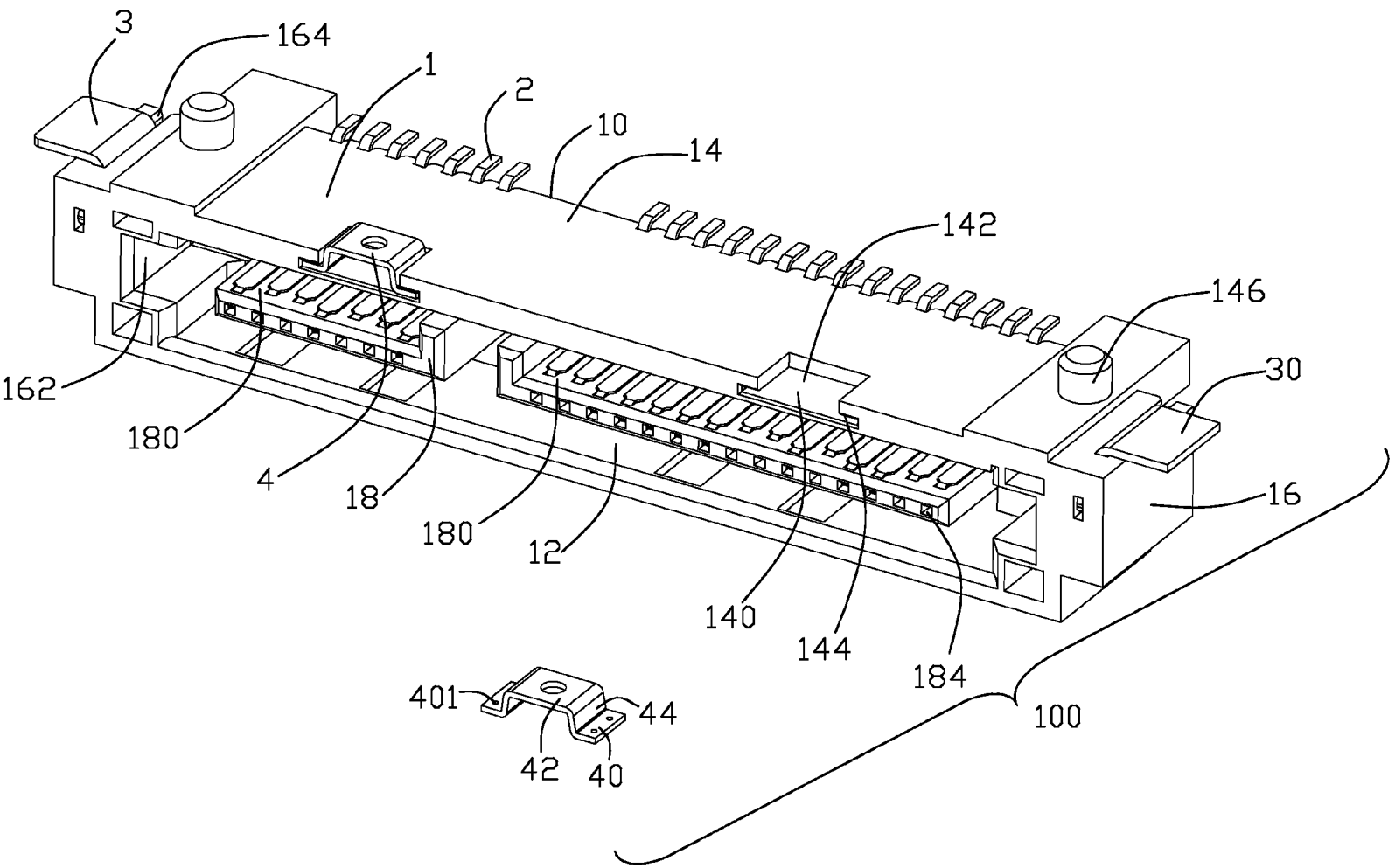
FIG. 3 is a partly-exploded view of the electrical connector of FIG. 1.
Figure 4:
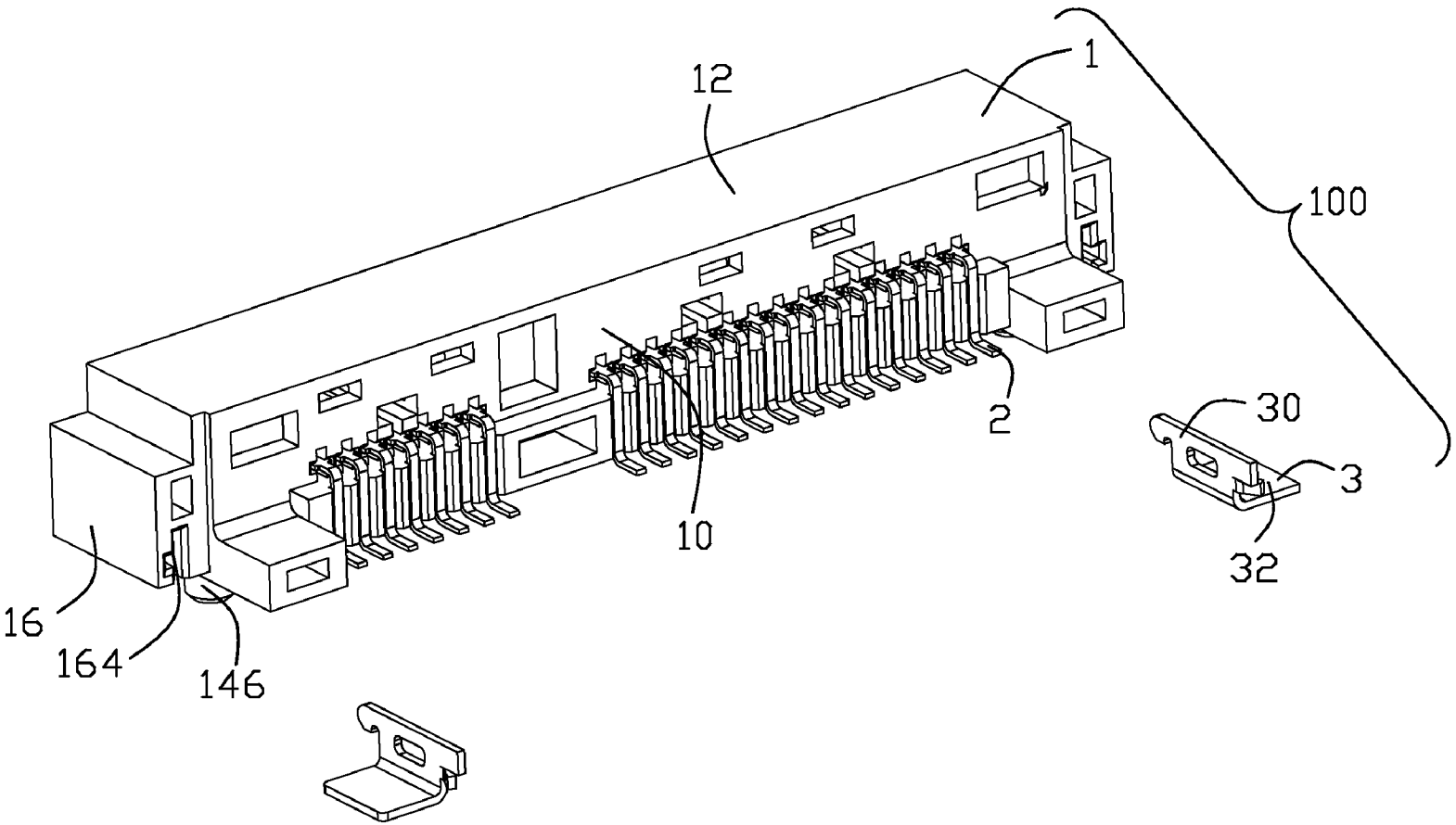
FIG. 4 is another partly-exploded view of the electrical connector of FIG. 1.

Referring to FIGS. 1 to 4, in one prefer embodiment of the present invention, an electrical connector 100 is electrically mounted onto a printed circuit board 5 of a optical disk driver (not shown) for mating with a complementary connector (not shown). The connector 100 includes an insulative housing 1, a plurality of contacts 2 inserted into the insulative housing 1 and retaining members 3, 4 fixed in the insulative housing 1 for fastening the insulative housing 1 onto the circuit board 5.

The insulative housing 2 is shown to include a base portion 10, a top wall 12 and a bottom wall 14 separately extending forwardly from the top and bottom of the base portion 10 and being parallel with each other, two parallel side walls 16 extending forwardly from two side ends of the base portion 10 and conjoining the top wall 12 with the bottom wall 14, and an inserting portion 18 extending forwardly from the middle of the base portion 10. The base portion 10, the top wall 12, the bottom wall 14 and the two side walls 16 together form a receiving space (not labeled). Extending from the bottom wall 14 of the insulative housing 1, there defines two orienting post 146 protruding towards the circuit board 5.

The surface facing to bottom of the inserting portion 18 forms an inserting face 180, which is divided into a power inserting area and a signal inserting area, the two inserting areas both are boards with a L shape with a plurality of contact slots 184 formed therein. At the inner side of the two side walls 16, there both defines a guide slot 162 that connecting with the receiving space for guiding the insertion of the complementary connector. On inner side of the side walls 16 of the insulative housing 1, there defines a retaining slot 164 extending from front to back, the retaining slot 164 runs through the bottom and front end wall of the side wall 16. On the bottom wall 14 of the insulative housing 1, there defines two receiving slots 140 with a T shape in direct project at intervals of distance. The two receiving slots 140 lie under the power inserting area and the signal inserting area of the inserting portion 18, the receiving slots 140 are formed extending rearward from the front end of the bottom wall 14 of the insulative housing 1, which includes a perforating portion 142 running through the bottom surface of the bottom wall 14 and connecting with external and two stop slots 144 extending towards left and right from the top wall of the perforating portion 142.

Each contact 2 includes a mating section 21 exposed out of the inserting face 180 for mating with the complementary connector, a tail section 22 for soldering with the corresponding solder pad of the circuit board 5 and a orienting section 23 connecting the mating section 21 and the tail section 22. The orienting section 23 includes a horizontal portion 231 connecting with the mating section 21 and a perpendicular portion 232 connecting with the tail section 22. The horizontal portion 231 has several inserting teeth 233 for mating with the inner wall of contact slot 184 to realize a retaining function.

The retaining member includes two first retaining patches 3 fixed in the retaining slots 164 on two side walls 16 of the insulative housing 1 and two second retaining patches 4 fixed in the receiving slot 140 on the bottom wall of the insulative housing 1. Wherein, the first retaining patch 3 is generally a L shape, which includes a retaining portion 30 fixed in the retaining slot 164 and a solder portion 32 extending agley from the retaining portion 30 for soldering with the circuit board 5. The second retaining patch 4 includes a retaining portion 40 inserted in the stop slot 144 of the receiving slot 140, a conjoint portion 42 protruding out of the bottom surface of bottom wall 14 of the insulative housing 1 through the perforating portion 142 of the receiving slot 140 and a connecting portion 44 within the perforating portion 142 for connecting the conjoint portion 42 and the retaining portion 40. The conjoint portion 42 is a soldering flat for soldering with the circuit board 5. The conjoint portion 42 is defined almost parallel with the retaining portion 40. Several protruding points 401 form on the retaining portion 40, the second retaining patch 4 are stably fastened in the receiving slot 140 through the protruding points 401 mating with the stop slot 144 of the receiving slot 140.

When the connector 100 is mounted on the circuit board 5, the tail section 22 of the contact 2 is soldered with the corresponding circuit of the circuit board 5. The first retaining patches 3 connect with the circuit board 5 through the solder portion 32 soldering with the circuit board 5. The orienting posts 146 extending from the bottom wall 14 insert into the corresponding through holes (not labeled) in the circuit board 5. The second retaining patches 4 are fastened onto the circuit board 5 through the conjoint portion 42 protruding out of the bottom wall 14 soldering with the circuit board 5, therefore, the connector 100 is fastened onto the circuit board 5. when inserting or pull off the complementary connector, the insert/pull off force focus on the inserting portion, as the second retaining patches 4 are mounted on the front end of the insulative housing 1, the connector won't drop from the circuit board 5 even if the insert force is too large or the insert direction is slant.

While said description is only one preferred embodiment according with the present invention, the number of the second retaining patch according to the present invention are not limit in this embodiment, in other embodiments, the number of the second retaining patch may be one or several.

While the present invention has been described with reference to preferred embodiments, the description of the invention is illustrative and is not to be construed as limiting the invention. Various of modifications to the present invention can be made to preferred embodiments by those skilled in the art without departing from the true spirit and scope of the invention as defined by the appended claims.

What is claimed is:

1. An electrical connector for mounting on a circuit board for mating with a complementary connector, comprising:

an insulative housing comprising a base portion, inserting portions extending forwardly from the base portion and a bottom wall extending forwardly from a bottom of the base portion, at least one receiving slot being defined on a front end of the bottom wall;

a plurality of contacts inserted into the insulative housing, each contact comprising a mating section and a tail section for conjoining with the circuit board;

two first retaining patches fixed on two opposite ends of the insulative housing; and at least one second retaining patch received in said at least one receiving slot;

wherein said at least one receiving slot runs through the front end of the bottom wall and comprises a perforating portion perforating the bottom wall and facing the circuit board and two stop slots on two opposite sides of the perforating portion;

wherein said at least one second retaining patch comprises a retaining portion inserted in the stop slot of the at least one receiving slot, a conjoint portion protruding out of the perforating portion and a connecting portion within the perforating portion for connecting the retaining portion and the conjoint portion;

wherein said retaining portion of the at least one second retaining patch is formed on two sides thereof with a right angle retaining portion and each of the right angle retaining portions having a plurality of protruding points mating with the stop slot of the at least one receiving slot;

wherein the inserting portion of the insulative housing is formed with a L shape, which comprises a power inserting area and a signal inserting area;

wherein the insulative housing has a top wall parallel with said bottom wall extending from the top end of the base portion, and said top wall, bottom wall and two side walls together form a receiving space with said inserting portion formed therein; and wherein there are two second retaining patches, and the two second retaining patches are separately fixed on the bottom wall under corresponding two inserting areas, the retaining patches being sandwiched between the bottom wall and the circuit board and located under a middle region of the respectively inserting portions.

2. The electrical connector of claim 1, wherein the insulative housing has two side walls, and a retaining slot is formed in the side wall for receiving said first retaining patch.

3. The electrical connector of claim 1, wherein two orienting posts are formed extending from two opposite ends of the bottom wall towards the circuit board for mating with corresponding through holes in the circuit board.

* * * * *